US011511449B1

(12) United States Patent
Zeng

(10) Patent No.: US 11,511,449 B1
(45) Date of Patent: Nov. 29, 2022

(54) BACK SHAVER

(71) Applicant: NATURE LAB CORPORATION, Aurora, CO (US)

(72) Inventor: Xianqin Zeng, Aurora, CO (US)

(73) Assignee: NATURE LAB CORPORATION, Aurora, CO (US)

( * ) Notice: Subject to any disclaimer, the term of this patent is extended or adjusted under 35 U.S.C. 154(b) by 0 days.

(21) Appl. No.: 17/751,923

(22) Filed: May 24, 2022

(51) Int. Cl.
*B26B 21/40* (2006.01)
*B26B 21/52* (2006.01)

(52) U.S. Cl.
CPC ..... *B26B 21/4012* (2013.01); *B26B 21/521* (2013.01); *B26B 21/522* (2013.01)

(58) Field of Classification Search
None
See application file for complete search history.

(56) References Cited

U.S. PATENT DOCUMENTS 4,970,784 A * 11/1990 Althaus ..... B26B 21/225 30/527
6,311,400 B1 * 11/2001 Hawes ..... B26B 21/225 30/527
9,937,629 B1 * 4/2018 Dryfhout ..... B26B 21/4031
11,345,056 B1 * 5/2022 Wang ..... B26B 21/14
2006/0080839 A1 * 4/2006 Hesketh ..... B26B 21/4012 30/50
2006/0283025 A1 * 12/2006 Folio ..... B26B 21/225 30/527
2010/0083505 A1 * 4/2010 Royle ..... B26B 21/225 30/527
2012/0124840 A1 * 5/2012 Iaccarino ..... B26B 21/521 30/50
2012/0210586 A1 * 8/2012 Lelieveld ..... B26B 19/04 30/527
2016/0288349 A1 * 10/2016 Barrett ..... B26B 21/4018
2018/0079095 A1 * 3/2018 Robertson ..... B26B 21/24

FOREIGN PATENT DOCUMENTS

EP 0 987 088 A1 * 3/2000

* cited by examiner

*Primary Examiner* — Hwei-Siu C Payer
(74) *Attorney, Agent, or Firm* — Daniel M. Cohn; Howard M Cohn

(57) ABSTRACT

A back shaver includes a cutter head assembly and a handle. The handle is connected to the cutter head assembly. The cutter head assembly includes a cutter head frame, cutter heads, and a connecting member. The cutter heads are embedded in a front surface of the cutter head frame. A back surface of the cutter head frame is connected to the connecting member through rotating shafts. An additional weight mechanism is disposed on the back surface of the cutter head frame, and the additional weight mechanism is further disposed close to an upper edge of the back surface of the cutter head frame. The present disclosure has advantages of simple design and structure, good hand feeling, effortless operation, which achieves good shaving effect.

9 Claims, 6 Drawing Sheets

BACK SHAVER

TECHNICAL FIELD

The present disclosure relates to a technical field of shavers, and in particular to a back shaver.

BACKGROUND

At present, back shavers on market are composed of a cutter head assembly and a handle. A design structure of conventional back shavers is very complex, thereby being troublesome to manufacture and assemble. During using the conventional back shavers, a large amount of force is required for shaving body hair, the force is difficult to grasp, so that operating hand feeling of the back shavers is poor, using the back shavers takes a lot of effort, and even the body hair cannot be removed as clean as possible.

SUMMARY

In order to solve problems that conventional back shavers are complex in design structure, inconvenient to operation, taking a lot of effort of users, and poor in hand feeling, the present disclosure provides a back shaver, the back shaver is easy and effortless during use, which has a good operating hand feeling and further realizes a good shaving effect.

The present disclosure provides a back shaver, including a cutter head assembly and a handle. The handle is connected to the cutter head assembly. The cutter head assembly includes a cutter head frame, cutter heads, and a connecting member. The cutter heads are embedded in a front surface of the cutter head frame. A back surface of the cutter head frame is connected to the connecting member through rotating shafts. An additional weight mechanism is disposed on the cutter head frame.

Furthermore, the additional weight mechanism is disposed on the back surface of the cutter head frame, and the additional weight mechanism is further disposed close to an upper edge of the back surface of the cutter head frame.

Furthermore, the additional weight mechanism is a counterweight block, and a weight range of the counterweight block is 10 g-30 g.

Furthermore, the counterweight block is made of a metal material.

Furthermore, two distances from two sides of the counterweight block corresponding to two sides of the cutter head frame are equal.

Furthermore, the counterweight block and the cutter head frame are fixedly connected through screws.

Furthermore, limiting grooves are defined on the back surface of the cutter head frame, limiting stop blocks are disposed on the connecting member, and the limiting stop blocks rotate in the limiting grooves, so that a range of a rotation angle of the cutter head frame rotating corresponding to the connecting member is not greater than 30°.

Furthermore, the limiting grooves and the limiting stop blocks share a same axis with the rotating shafts.

Furthermore, elastic sheets are disposed on one side, close to the cutter head frame, of the connecting member. Sliding blocks are disposed on the back surface of the cutter head frame, and free ends of the elastic sheets slide corresponding to the sliding blocks.

Furthermore, each of the sliding blocks is an arc-shaped convex block, one end of the arc-shaped convex block is close to a first end of the cutter head frame, and a second end of the arc-shaped convex block is close to a lower edge of the cutter head frame.

Furthermore, a number of the sliding blocks is two, and a number of the elastic sheets corresponding to the sliding blocks is two.

The back shaver of the present disclosure has following beneficial technical effects.

In the back shaver of the present disclosure, the additional weight mechanism is disposed on the back surface of the cutter head frame, and the additional weight mechanism is further disposed close to an upper edge of the back surface of the cutter head frame, so that time and effort are saved when operating the handle. The cutter head frame and the connecting member rotate with each other to generate a first force moment. Meanwhile, the elastic sheets disposed on the connecting member and the sliding blocks disposed on the back surface of the cutter head frame slide with each other to generate a second force moment opposite to the first force moment, so that the cutter heads gently rotate, and makes cutting edge surfaces of the cutter heads closely attached to body skins. An overall design of the present disclosure has advantages of simple structure, good hand feeling, effortless operation and good shaving effect.

BRIEF DESCRIPTION OF DRAWINGS

In order to more clearly illustrate technical solutions of embodiments of the present disclosure or prior art, accompanying drawings required in the embodiments or descriptions in the prior art are briefly described below. It should be apparent that the drawings in the following descriptions are merely some embodiments of the present disclosure, and for a person of ordinary skill in the art, other drawings may be obtained according to the drawings without creative efforts.

Figure 1:
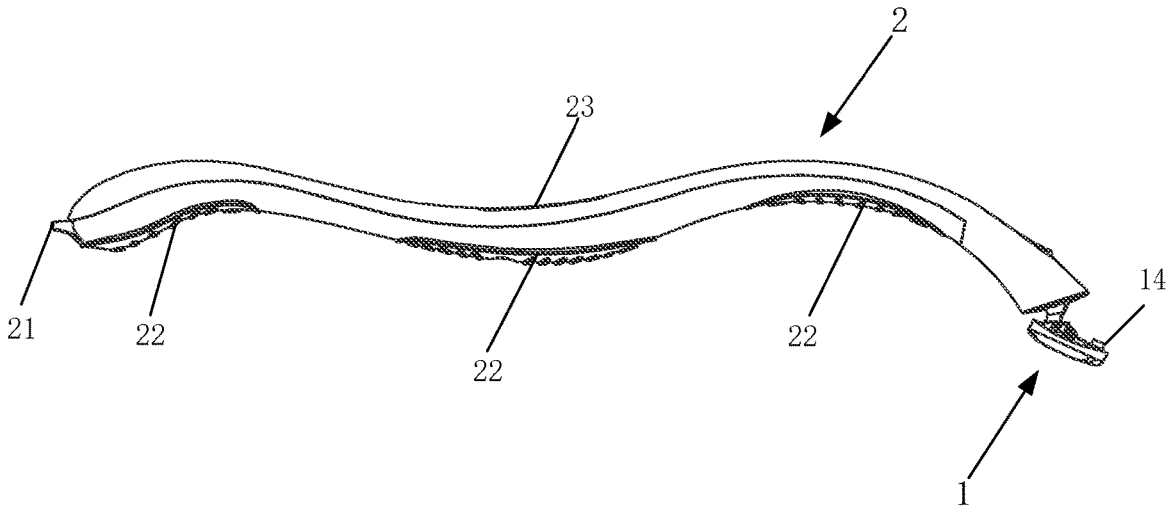
FIG. 1 is a structural schematic diagram of a back shaver according to a first embodiment of the present disclosure.
Figure 2:
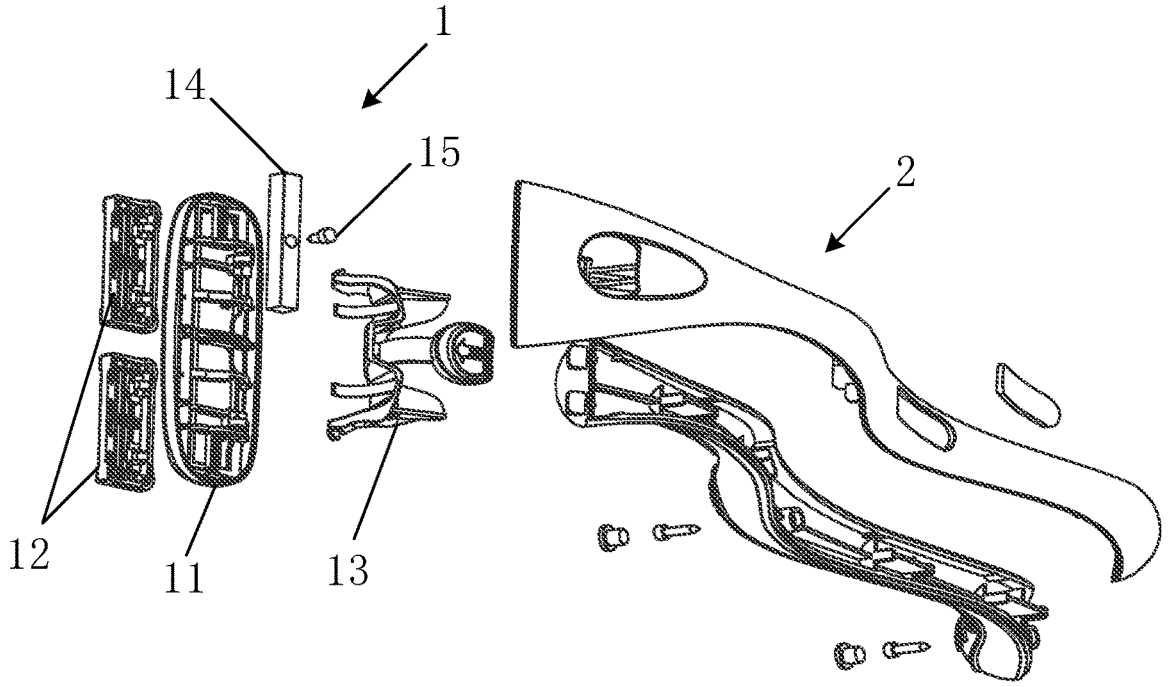
FIG. 2 is an exploded schematic diagram of the back shaver according to the first embodiment of the present disclosure.
Figure 3:
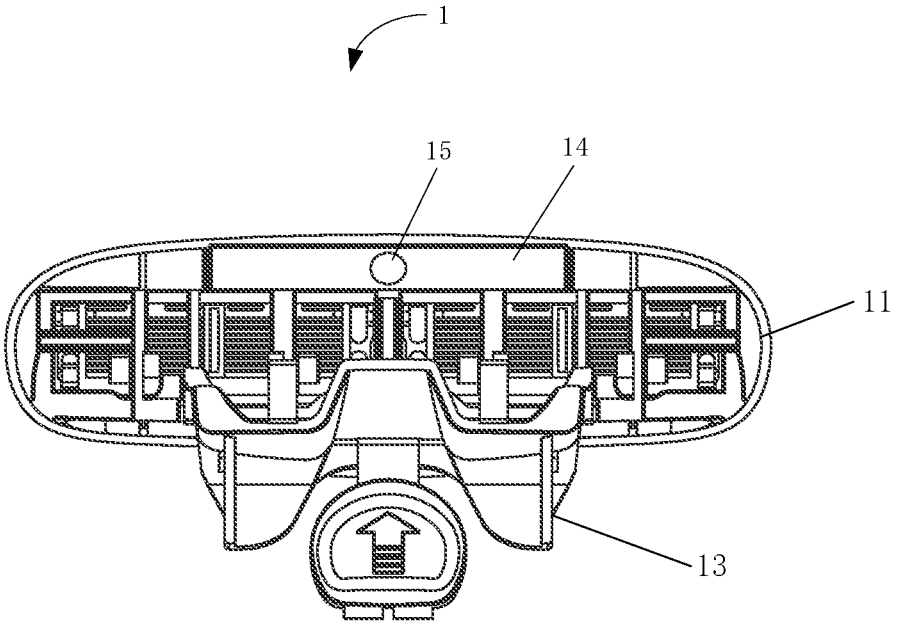
FIG. 3 is a structural schematic diagram of a cutter head assembly presented in a first angle according to the first embodiment of the present disclosure.
Figure 4:
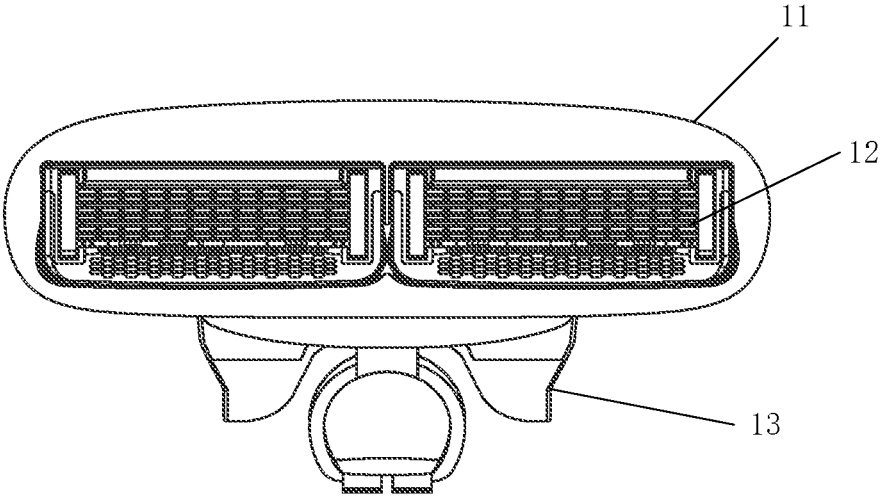
FIG. 4 is a structural schematic diagram of the cutter head assembly presented in a second angle according to the first embodiment of the present disclosure.

Reference number in the drawings: 1. cutter head assembly; 2. handle; 21. hole; 22. anti-sliding blocks; 23. LOGO adhesive tape; 11. cutter head frame; 12. cutter heads; 13. connecting member; 14. counterweight block; 15. screws; 111. grooves; 112. shaft holes; 113. sliding blocks; 114. limiting grooves; 131. rotating shafts; 132. elastic sheets; 133. limiting stop blocks.

DETAILED DESCRIPTION

Technical solutions in embodiments of the present disclosure are clearly and completely described below with reference to accompanying drawings in the embodiments of the present disclosure. Obviously, the described embodiments are only a part of the embodiments of the present disclosure, rather than all of the embodiments. All other embodiments obtained by a person of ordinary skill in art based on the embodiments of the present disclosure without creative efforts shall fall within a protection scope of the present disclosure.

It should be noted that terms "front", "rear", "left", "right", "upper" and "lower" used in descriptions below refer to directions in the drawings, and terms "inner" and "outer" refer to directions toward or away from a geometric center of a specific component, respectively.

Referring to FIG. 1, first embodiment of the present disclosure includes a cutter head assembly 1 and a handle 2, and the handle 2 is connected to the cutter head assembly 1. The handle 2 is generally a curved elongated member. A hole 21 is defined on one end, distal from the cutter head assembly 1, of the handle 2. The hole 21 is configured to mount a hanging rope. Anti-sliding blocks 22 are disposed on a plurality of hand holding portions of the handle 2, so that the handle 2 is conveniently held when being held in a hand-held mode. A LOGO adhesive tape 23 is further disposed on one side of the handle 2. The cutter head assembly 1 and the handle 2 are detachably connected, and of course, the cutter head assembly 1 and the handle 2 are further integrally formed.

As shown in FIGS. 2-5, in the first embodiment of the present disclosure, the cutter head assembly 1 is formed by assembling a cutter head frame 11, cutter heads 12, and a connecting member 13.

Grooves 111 are defined in a front surface of the cutter head frame 11. A periphery of each of the grooves 111 is a frame, and a shape of each of the grooves 111 is approximately rectangular. One or more of the grooves 111 are employed, and an array distribution is configured when a plurality of grooves 111 are employed. The cutter heads 12 are embedded in the grooves 111. When the cutter heads 12 are installed or taken out from the grooves 111, it is convenient to replace the cutter heads 12. Optionally, two grooves 111 are defined in the front surface of the cutter head frame 11. One of the cutter heads 12 is disposed in each of the two grooves 111 disposed in a line. In the first embodiment, the number of the cutter heads 12 is reasonable, an appearance design is attractive, a cost is reduced, and a shaving area is increased.

Shaft holes 112 are respectively defined in each of two ends of a back surface of the cutter head frame 11 in a length direction. The shaft holes 112 and the cutter head frame 11 are integrally disposed. Rotating shafts 131 are respectively disposed on two ends of the connecting member 13, and the rotating shafts 131 are rotatably connected to the shaft holes 112 of the cutter head frame 11. The rotating shafts 131 and the shaft holes 112 are on same axes. In order to enhance a hand feeling during use, an additional weight mechanism is further disposed on the back surface of the cutter head frame 11. Optionally, the additional weight mechanism is a counterweight block 14. Two distances from two sides of the counterweight block 14 corresponding to two sides of the cutter head frame 11 are equal. In other words, after the additional weight mechanism is added to the back surface of the cutter head frame 11, a center of gravity of a long side direction of the cutter head frame 11 is kept on a center line of a long side of the cutter head frame 11. A weight range of the counterweight block 14 is preferably 10 g-30 g. The counterweight block 14 made of a metal material is small in size and convenient in weight selection, which is disposed on the back surface of the cutter head frame 11 close to an upper edge of the cutter head frame 11, so that the center of gravity of the cutter head frame 11 is close to the upper edge of the cutter head frame 11 along the center line of the long side. From a whole structure of the back shaver, the counterweight block 14 is disposed at a tail end of the handle 2 as much as possible, and an optimal counterweight effect is achieved. In order to facilitate a replacement of the counterweight block 14, the counterweight block 14 and the cutter head frame 11 are connected and fixed through screws 15. Furthermore, in order to better fix the counterweight block 14, an opening groove is defined on the back surface of the cutter head frame 11. The opening groove is matched with the counterweight block 14 so as to prevent the counterweight block 14 from shaking up and down or left and right to affect the operation hand feeling.

After the counterweight block 14 is disposed on the back surface of the cutter head frame 11, when the handle 2 of the hand-held back shaver is used, since the counterweight block 14 is disposed at one end, close to the cutter head assembly 1, on the handle 2 as the elongated member. The cutter heads 12 of the cutter head frame 11 make contact with the skin without exerting force through the handle 2, and the hand feeling is good.

Figure 5:
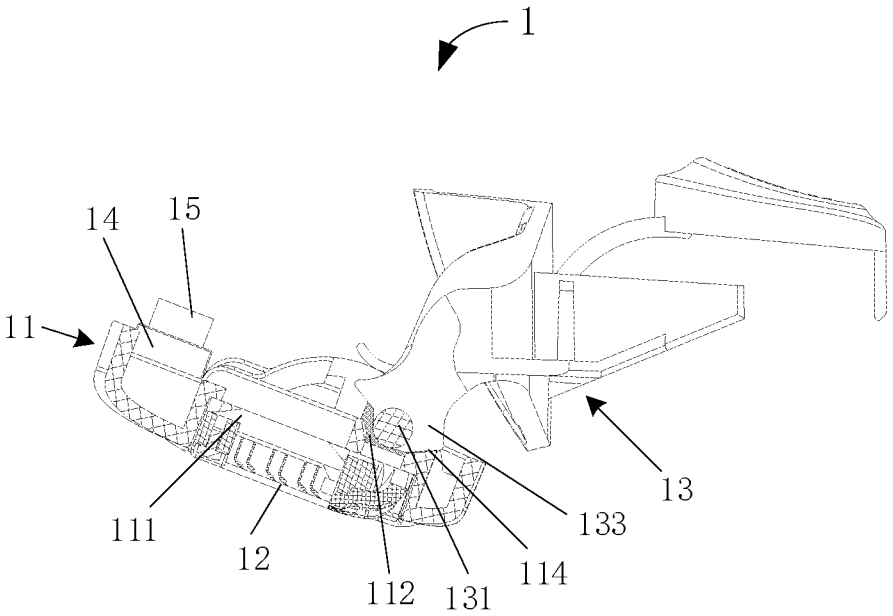
FIG. 5 is a cross-sectional schematic diagram of the cutter head assembly according to the first embodiment of the present disclosure.
Figure 6:
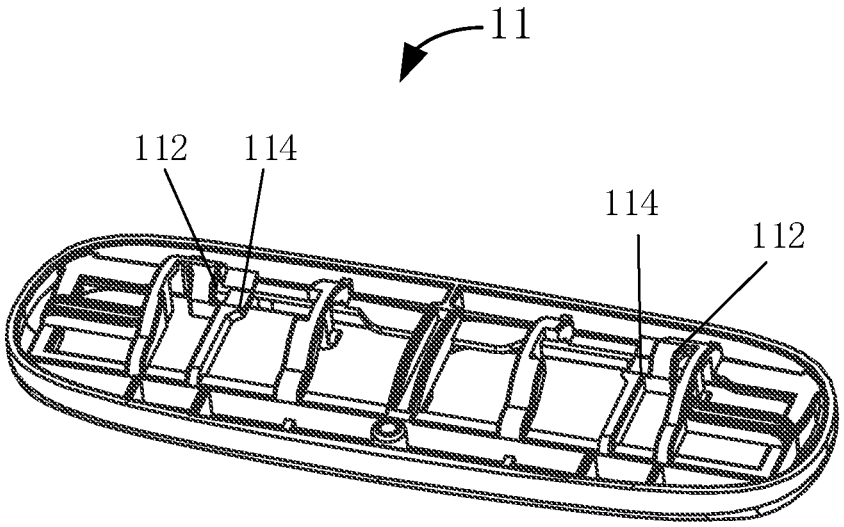
FIG. 6 is a structural schematic diagram of a cutter head frame according to the first embodiment of the present disclosure.
Figure 7:
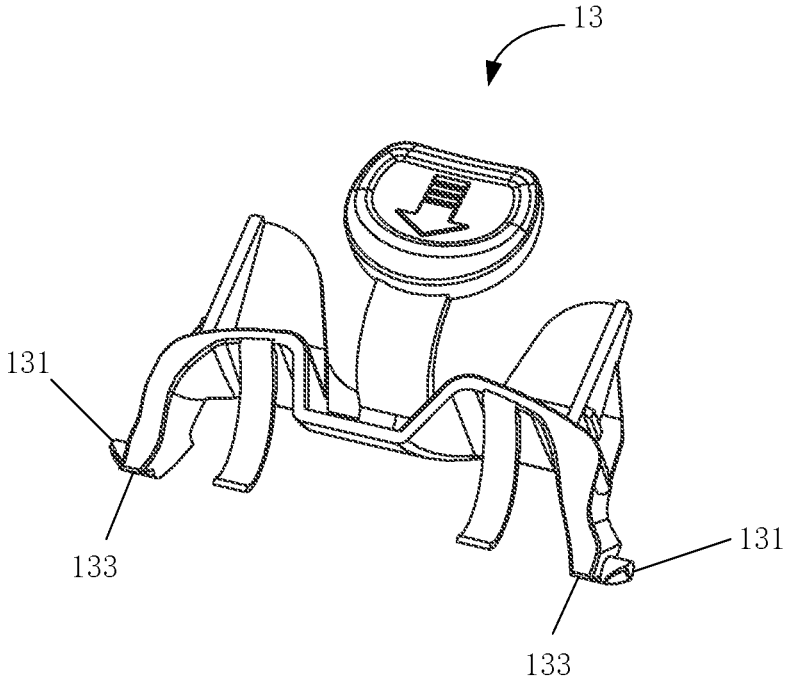
FIG. 7 is a structural schematic diagram of a connecting member according to the first embodiment of the present disclosure.

Optionally, as shown in FIGS. 5-7, limiting grooves 114 are defined at two ends of the back surface of the cutter head frame 11, and limiting stop blocks 133 are disposed, corresponding to the limiting grooves 114, on the connecting member 13. The limiting stop blocks 133 rotate relatively in the limiting grooves 114, so that a range of a relative rotation angle of the cutter head frame 11 and the connecting member 13 is not greater than 30°. The limiting grooves 114, the limiting stop blocks 133, central shafts of the shaft holes 112, and central shafts of the rotating shafts 131 on same axes. When the back shaver is used, the range of the rotation angle of the cutter head frame 11 is not greater than 30°, so that cutting edge surfaces of the cutter heads 12 are approximately in a skin direction, and the operation is convenient.

Figure 8:
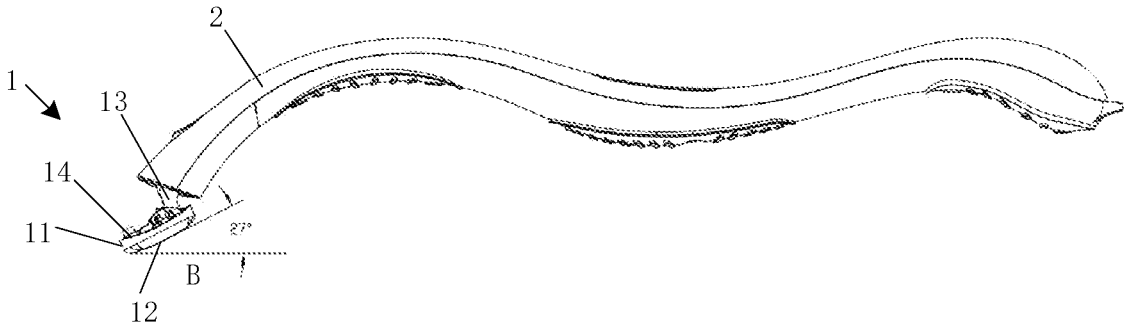
FIG. 8 is a structural schematic diagram of the back shaver according to the first embodiment of the present disclosure where the back shaver is in an initial state.

As shown in FIG. 8, in an initial state, under the gravity of the counterweight block 14, the cutter head frame 11 realizes contact and anchoring of a front upper edge of the cutter head frame 11 with skin B (the skin B is regarded as a horizontal state). At this time, the handle 2 does not apply a force to the cutter head assembly 1, and an included angle between a plane where the cutter heads 12 are disposed and the skin B is 27°.

Figure 9:
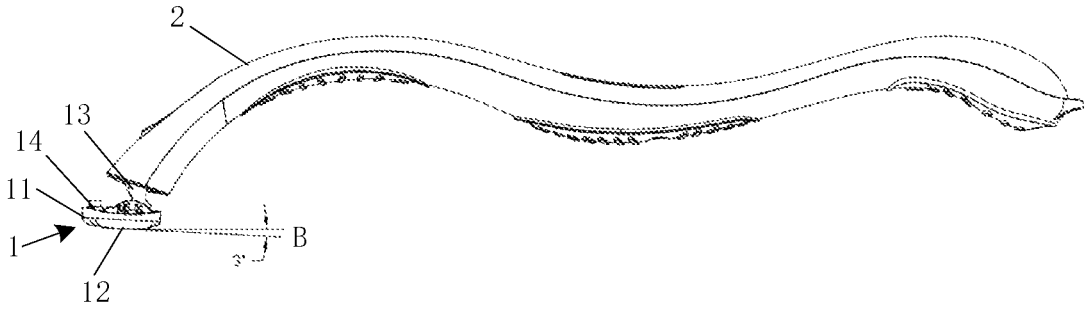
FIG. 9 is a structural schematic diagram of the back shaver according to the first embodiment of the present disclosure where the back shaver is in a using state.

As shown in FIG. 9, when in use, the handle 2 applies a force to the cutter head frame 11, so that the cutter head frame 11 and the connecting member 13 rotate with each other and generate the rotation force moment. Taking the upper edge of the cutter head frame 11 as a rotation axis, the cutter head frame 11 rotates in a direction of the skin B. After the plane where the cutter heads 12 on the front surface of the cutter head frame 11 is completely attached to the skin B, the cutter head frame 11 continues to rotate, and the cutter heads 12 on the front surface of the cutter head frame 11 are recessed 3° below the skin B, so that the cutting edge surfaces of the cutter heads 12 are closely attached to the skin B, and when the handle 2 is moved, smooth shaving is achieved.

The first embodiment of the present disclosure has following beneficial technical effects.

In the back shaver of the present disclosure, the additional weight mechanism is disposed on the back surface of the cutter head frame, and the additional weight mechanism is further disposed close to an upper edge of the back surface of the cutter head frame, during the operation of the handle, the present disclosure has advantages of simple structure, good hand feeling, effortless operation, and good shaving effect.

Figure 10:
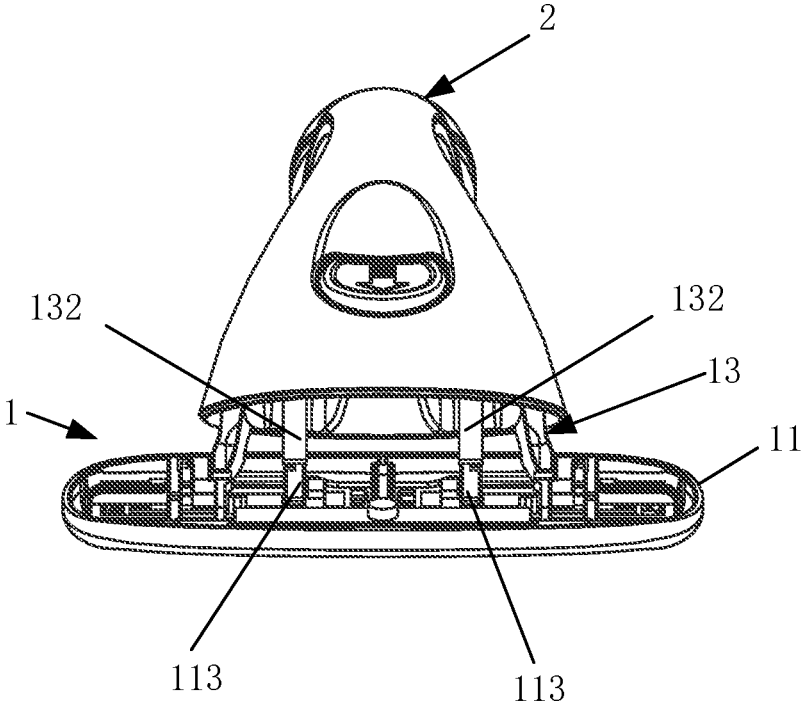
FIG. 10 is a structural schematic diagram of the back shaver according to a second embodiment of the present disclosure.
Figure 11:
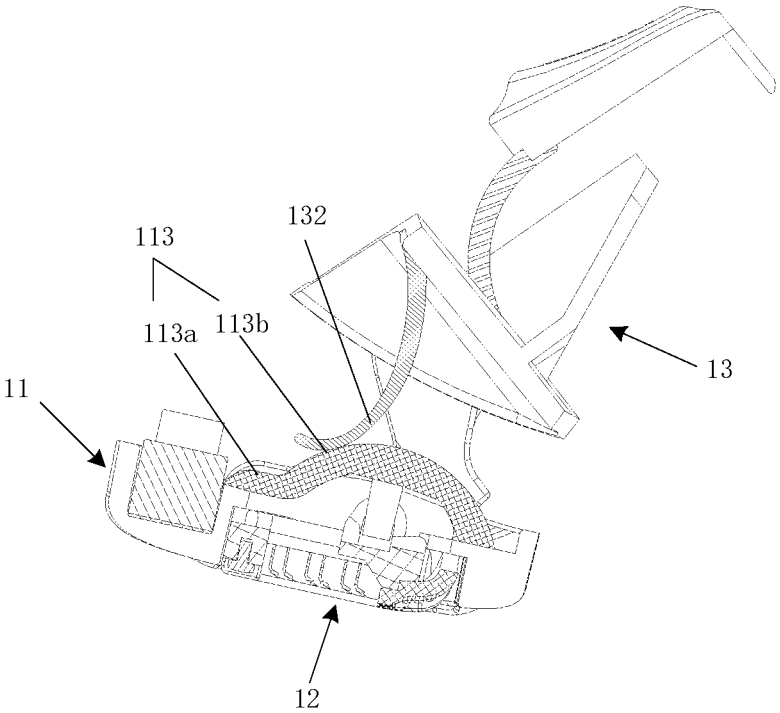
FIG. 11 is a cross-sectional schematic diagram of a cutter head assembly according to the second embodiment of the present disclosure.

Referring to FIG. 10-11, in order to achieve the better shaving effect of the back shaver, on a basis of the above-mentioned first embodiment, as a further improvement, a second embodiment is proposed, and most of structures of the second embodiment are the same as the first embodiment. The back shaver is assembled and formed by a cutter head assembly 1 and a handle 2. Two elastic sheets 132 having same structures are disposed on one side, distal from the handle 2, of a connecting member 13. Each of the elastic sheets 132 is of an arc-shaped structure, and optionally, the elastic sheets 132 and the connecting member 13 are integrally formed. Sliding blocks 113 are disposed, corresponding to the elastic sheets 132, on a back surface of the cutter head frame 11. When the cutter head frame 11 rotates relative to the connecting member 13, free end of each of the elastic sheets 132 slides relative to a surface of a corresponding one of the sliding blocks 113.

Each of the sliding blocks 113 is an arc-shaped convex block, including a first arc-shaped portion 113*a* and a second arc-shaped portion 113*b*. One end of the first arc-shaped portion 113*a* is close to an upper edge of the back surface of the cutter head frame 11, and the other end of the first arc-shaped portion 113*a* is in a transitional connection with one end of the second arc-shaped portion 113*b*. The other end of the second arc-shaped portion 113*b* is close to a lower edge of the back surface of the cutter head frame 11. The second arc-shaped portion 113*b* is of an arc-shaped structure, and the arc-shaped structure protrudes towards an outer side of the back surface of the cutter head frame 11. Optionally, the sliding blocks 113 and the cutter head frame 11 are integrally formed, which facilitates assembly and reduces costs.

Furthermore, the number of the sliding blocks 113 is two, and the two sliding blocks 113 are identical in structure. The number of the elastic sheets 132 corresponding to the sliding blocks 113 is two. The free ends of the two elastic sheets 132 synchronously slide to the arc bottoms of the two sliding blocks 113 along the arc tops of the two sliding blocks 113, thereby increasing counter force generated through the force applied to the handle 2, improving stability of the relative rotation between the cutter head frame 11 and the connecting member 13, and better realizing that the cutting edge surfaces of the cutter heads 12 are smoothly in close contact with the skin, and the hair is removed smoothly and reliably.

When in use, the handle 2 is operated to exert a force between the cutter head frame 11 and the connecting member 13 to generate rotation force moment. The cutter head frame 11 and the connecting member 13 rotate relative to each other, so that cutting edge surfaces of the cutter heads 12 of the cutter head frame 11 contact the skin. While the cutter head frame 11 and the connecting member 13 rotate relatively, when the free end of each of the elastic sheets 132 slides to the first arc-shaped portion 113*a* along an arc top of the second arc-shaped portion 113*b* to generate another force opposite to the force, so that the cutter head frame 11 is gently rotated relative to the connecting member 13, the cutting edge surfaces of the cutter heads 12 are closely attached to the skin along the undulating skin, and the cutting edge surfaces of the cutter heads 12 smoothly close to the skin, thereby smoothly and reliably removing hair.

The second embodiment of the present disclosure has the following beneficial technical effects:

Applying a force moment on the connecting member relative to the cutter head frame through the handle, the free end of each of the elastic sheets slides along one end of the corresponding one of the sliding blocks to the other end of the corresponding one of the sliding blocks to generate the second force moment against the first force moment and reaches a balance, so that the cutter head surface of the cutter head frame rotates smoothly, and a cutting edge surface of the cutter head clings tightly along the undulating skin, thereby achieving a smooth shaving effect. The back shaver of the present disclosure is simple in design structure and conforms to ergonomic, which is convenient to operate.

Obviously, the person of ordinary skill in the art makes various modifications and variations to the embodiments of the present disclosure without departing from spirit and scope of the embodiments of the present disclosure. Thus, if the modifications and variations of the embodiments of the present disclosure fall within the scope of claims of the present disclosure and equivalent technologies of the claims of the present disclosure, the present disclosure is further intended to include the modifications and variations.

What is claimed is:

1. A back shaver, comprising:

a cutter head assembly; and a handle;

wherein the handle is connected to the cutter head assembly, the cutter head assembly comprises a cutter head frame, cutter heads, and a connecting member; the cutter heads are embedded in a front surface of the cutter head frame, a back surface of the cutter head frame is connected to the connecting member through rotating shafts; and an additional weight mechanism is disposed on the cutter head frame;

the additional weight mechanism is disposed on the back surface of the cutter head frame, and the additional weight mechanism is further disposed close to an upper edge of the back surface of the cutter head frame; and the additional weight mechanism is a counterweight block, and a weight range of the counterweight block is 10 g-30 g.

2. The back shaver according to claim 1, wherein the counterweight block is made of a metal material.

3. The back shaver according to claim 2, wherein two distances from two sides of the counterweight block corresponding to two sides of the cutter head frame are equal.

4. The back shaver according to claim 3, wherein the counterweight block and the cutter head frame are fixedly connected through screws.

5. The back shaver according to claim 1, wherein limiting grooves are defined on the back surface of the cutter head frame, limiting stop blocks are disposed on the connecting member, and the limiting stop blocks rotate in the limiting grooves, so that a range of a rotation angle of the cutter head frame rotating corresponding to the connecting member is not greater than 30°.

6. The back shaver according to claim 5, wherein the limiting grooves and the limiting stop blocks share the same axis with the rotating shafts.

7. The back shaver according to claim 1, wherein elastic sheets are disposed on one side, close to the cutter head frame, of the connecting member; sliding blocks are disposed on the back surface of the cutter head frame, and free ends of the elastic sheets each side relative to a corresponding one of the sliding blocks when the cutter head frame rotates relative to the connecting member.

8. The back shaver according to claim 7, wherein each of the sliding blocks is an arc-shaped convex block, a first end of the arc-shaped convex block is close to an upper edge of the cutter head frame, and a second end of the arc-shaped convex block is close to a lower edge of the cutter head frame.

9. The back shaver according to claim 8, wherein a number of the sliding blocks is two, and a number of the elastic sheets corresponding to the sliding blocks is two.

* * * * *